US009884365B2

(12) United States Patent
Bochiechio et al.

(10) Patent No.: US 9,884,365 B2
(45) Date of Patent: Feb. 6, 2018

(54) SHOT TUBE FOR DIE-CAST MACHINE

(71) Applicant: UNITED TECHNOLOGIES CORPORATION, Hartford, CT (US)

(72) Inventors: Mario P. Bochiechio, Vernon, CT (US); Yee Ling Kwan, Singapore (SG); Carl R. Verner, Windsor, CT (US)

(73) Assignee: United Technologies Corporation, Farmington, CT (US)

( * ) Notice: Subject to any disclaimer, the term of this patent is extended or adjusted under 35 U.S.C. 154(b) by 0 days.

(21) Appl. No.: 14/767,011

(22) PCT Filed: Mar. 6, 2014

(86) PCT No.: PCT/US2014/021022

§ 371 (c)(1),
(2) Date: Aug. 11, 2015

(87) PCT Pub. No.: WO2014/164171

PCT Pub. Date: Oct. 9, 2014

(65) Prior Publication Data

US 2016/0031004 A1 Feb. 4, 2016

Related U.S. Application Data

(60) Provisional application No. 61/775,725, filed on Mar. 11, 2013.

(51) Int. Cl.
*B22D 17/20* (2006.01)
*B22D 17/22* (2006.01)
(Continued)

(52) U.S. Cl.
CPC ..... *B22D 17/2023* (2013.01); *B22D 17/203* (2013.01); *B22D 17/22* (2013.01);
(Continued)

(58) Field of Classification Search
CPC ..... B22D 17/08–17/12; B22D 17/2023; B22D 17/229; B22D 17/26; B22D 17/263; B22D 17/266
See application file for complete search history.

(56) References Cited

U.S. PATENT DOCUMENTS 3,528,478 A * 9/1970 Navarro ..... B22D 17/00 164/113
3,664,411 A 5/1972 Carver et al.
(Continued)

FOREIGN PATENT DOCUMENTS

EP 1918043 A1 5/2008
EP 2489451 A2 8/2012
(Continued)

OTHER PUBLICATIONS

Int'l Search Report from corresponding PCT/US14/21022.
(Continued)

*Primary Examiner* — Kevin E Yoon
*Assistant Examiner* — Jacky Yuen
(74) *Attorney, Agent, or Firm* — Carlson, Gaskey & Olds, PC

(57) ABSTRACT

A shot tube includes an inner bore for delivering molten material into a die-cast mold. The shot tube has an outer peripheral surface with at least one surface for receiving a locking member to lock the shot tube into an aperture in a fixed mold portion and an alignment structure for properly aligning the shot tube in the fixed mold portion. An opening receives molten material into the inner bore. A die-cast machine is also disclosed.

16 Claims, 2 Drawing Sheets

(51) Int. Cl.
*B22D 17/26* (2006.01)
*B22D 17/28* (2006.01)
*B22D 21/02* (2006.01)

(52) U.S. Cl.
CPC ..... *B22D 17/266* (2013.01); *B22D 17/28* (2013.01); *B22D 21/025* (2013.01)

(56) References Cited

U.S. PATENT DOCUMENTS

| | | | | |
|---|---|---|---|---|
| 5,322,111 | A * | 6/1994 | Hansma | B22D 17/2023 164/312 |
| 5,730,204 | A * | 3/1998 | Shimmell | B22D 17/08 164/130 |
| 6,651,727 | B1 | 11/2003 | Prince et al. | |
| 9,114,455 | B1 * | 8/2015 | Donahue | B22D 17/2023 |
| 2004/0084170 | A1 * | 5/2004 | Ervin | B22D 29/00 164/113 |
| 2012/0211193 | A1 | 8/2012 | Bochiechio et al. | |

FOREIGN PATENT DOCUMENTS

| | | | |
|---|---|---|---|
| JP | 02146394 | A | 6/1990 |
| JP | 3107723 | B2 * | 11/2000 |
| JP | 2004276352 | A * | 10/2004 |
| JP | 2005034867 | A | 2/2005 |
| JP | 2005214377 | A | 8/2005 |
| JP | 2012143770 | A | 8/2012 |

OTHER PUBLICATIONS

International Preliminary Report on Patentability for International Application No. PCT/US2014/021022 dated Sep. 24, 2015.

Supplementary European Search Report for European Application No. 14778429.2 dated Aug. 17, 2016.

* cited by examiner

SHOT TUBE FOR DIE-CAST MACHINE

CROSS-REFERENCE TO RELATED APPLICATION

This application claims priority to U.S. Provisional Application No. 61/775,725, filed Mar. 11, 2013.

BACKGROUND

This application relates to a shot tube for injecting molten metal into a die-cast mold.

Die casting is a metal casting technique that employs the use of permanent, reusable molds in which molten alloys are injected and compressed into the cavities to form the desired component. The die cast system is comprised of multiple components: the molds, the shot tube, the shot rod and piston, the frame of the machine, a hydraulic system, pneumatic system, and a programmable logic controller to control the interconnected systems.

Die-cast molds are known and utilized to form any number of components. A die-cast machine is comprised of a fixed platen and a moving platen. In a split die set one half of the mold mounts the stationary platen and the second half to the moveable platen. The moving platen is actuated by hydraulic piston, and mechanical clamping system to position the moveable die half in the appropriate position during each phase of the die casting process. A singular or array of cavities are formed between the two die halves in the shape of a component which is to be cast.

The desired alloy is liquefied by a variety of methods and is transferred to or directly poured through the opening in a shot tube. The molten alloy is added to the desired fill level for the component, the hydraulic injection system is activated, and the piston pushes the molten metal along the shot tube delivering the molten material into the cavity. As the molten metal begins to solidify, an intensification cycle can be used to further compress the semisolid alloy into the die cavity to minimize casting defects such as shrinkage and non-fill of the cavities. Upon solidification the component is formed into the shape of the cavity.

Historically, the shot tubes have been mounted to the fixed platen in traditional machines that operate in air. While this is suitable for low temperature alloy system, the stack up of tolerances that causes misalignment and gaps is extremely problematic for quick solidifying high temperature alloys. The desire to improve the quality of existing alloys and the opportunity to cast higher temperature capable alloys such as: steels, iron-nickel super alloys, nickel super alloys, and cobalt super alloys creates the need to operate the die casting system in a vacuum to ensure metallurgical quality and elimination of defects such as dross and ceramic inclusions from these alloy systems.

Conventional mounting of the shot tube poses significant challenges as a result of need to operate the system in a vacuum. Mounting the tube in the traditional manner would require extensive sealing between the tube and the platen to prevent the flow of an oxidizing atmosphere into the tube. In order to minimize vacuum leaks and maintenance of the tube an alternative method of mounting and aligning the tube is required to ensure optimal operation and serviceability of the equipment.

In one particular die-cast system, an electron beam device is utilized to melt an ingot of metal within a vacuum chamber. The molten metal drips into a water cooled copper crucible as the ingot is superheated by the electron beam. When a sufficient amount of material has filled the crucible, the electron beam sweeps across the surface until the system has achieved the desired temperature, the dross is swept to the rear of the crucible, the system is tilted and the molten metal is poured through the opening in the shot tube. In this embodiment, the fixed platen does not easily mount the shot tube.

SUMMARY

In a featured embodiment, a shot tube has an inner bore delivering molten material into a die-cast mold. The shot tube has an outer peripheral surface with at least one surface for receiving a locking member to lock the shot tube into a fixed mold portion and an alignment structure for properly aligning the shot tube in the fixed mold portion. An opening receives molten material into the inner bore.

In another embodiment according to the previous embodiment, the surface includes a pair of surfaces formed at an outer periphery of the shot tube.

In another embodiment according to any of the previous embodiments, the pair of surfaces are flats.

In another embodiment according to any of the previous embodiments, the shot tube outer periphery is cylindrical, other than at the flats.

In another embodiment according to any of the previous embodiments, the alignment structure includes a notch at a forward end of the shot tube.

In another embodiment according to any of the previous embodiments, the inner bore extends through an entire axial length of the shot tube.

In another embodiment according to any of the previous embodiments, the shot tube includes an inner portion formed of a powdered metal and an outer portion formed of stainless steel.

In another featured embodiment, a die-cast fixed mold portion has a mold body defining a mold cavity at least in part. An aperture in the mold body receives a shot tube. There is an alignment structure properly positioning the shot tube within the aperture. The shot tube has an inner bore for delivering molten material into the mold body. The shot tube has an outer peripheral surface with at least one surface receiving a locking member to lock the shot tube. An opening receives molten material into the inner bore.

In another embodiment according to the previous embodiment, the surface includes a pair of surfaces formed at an outer periphery of the shot tube.

In another embodiment according to any of the previous embodiments, the pair of surfaces are flats.

In another embodiment according to any of the previous embodiments, the shot tube outer periphery is cylindrical, other than at the flats.

In another embodiment according to any of the previous embodiments, the alignment structure includes a notch at a forward end of the shot tube and a tooth from the mold body.

In another embodiment according to any of the previous embodiments, the inner bore extends through an entire axial length of the shot tube.

In another embodiment according to any of the previous embodiments, the shot tube includes an inner portion formed of a powdered metal and an outer portion formed of stainless steel.

In another featured embodiment, a die-cast machine has a mold with a fixed mold portion and moveable mold portion, a piston and cylinder for moving the moveable mold portion along with a moveable platen, and a fixed platen for mounting the fixed mold portion. A vacuum chamber receives an ingot of metal to be melted. An electron beam apparatus melts the ingot, a copper crucible for receiving molten metal, and the copper crucible delivering molten metal into a shot tube through an opening in the shot tube. The first mold portion includes a mold body defining a mold cavity at least in part. An aperture in the fixed mold portion receives a shot tube. Alignment structure properly positions the shot tube within the mold body. The shot tube has an inner bore delivering molten material into the molds. The shot tube has an outer peripheral surface with at least one surface receiving a locking member to lock the shot tube into the aperture. An opening receives molten material into the inner bore.

In another embodiment according to the previous embodiment, the surface includes a pair of surfaces formed at an outer periphery of the shot tube.

In another embodiment according to any of the previous embodiments, the shot tube outer periphery is cylindrical, other than at the pair of surfaces formed at the outer periphery of the shot tube.

In another embodiment according to any of the previous embodiments, the alignment structure includes a notch at a forward end of the shot tube and a tooth from the mold body.

In another embodiment according to any of the previous embodiments, the inner bore extends through an entire axial length of the shot tube.

In another embodiment according to any of the previous embodiments, the shot tube includes an inner portion formed of a powdered metal and an outer portion formed of stainless steel.

These and other features may be best understood from the following drawings and specification.

DETAILED DESCRIPTION

Figure 1:
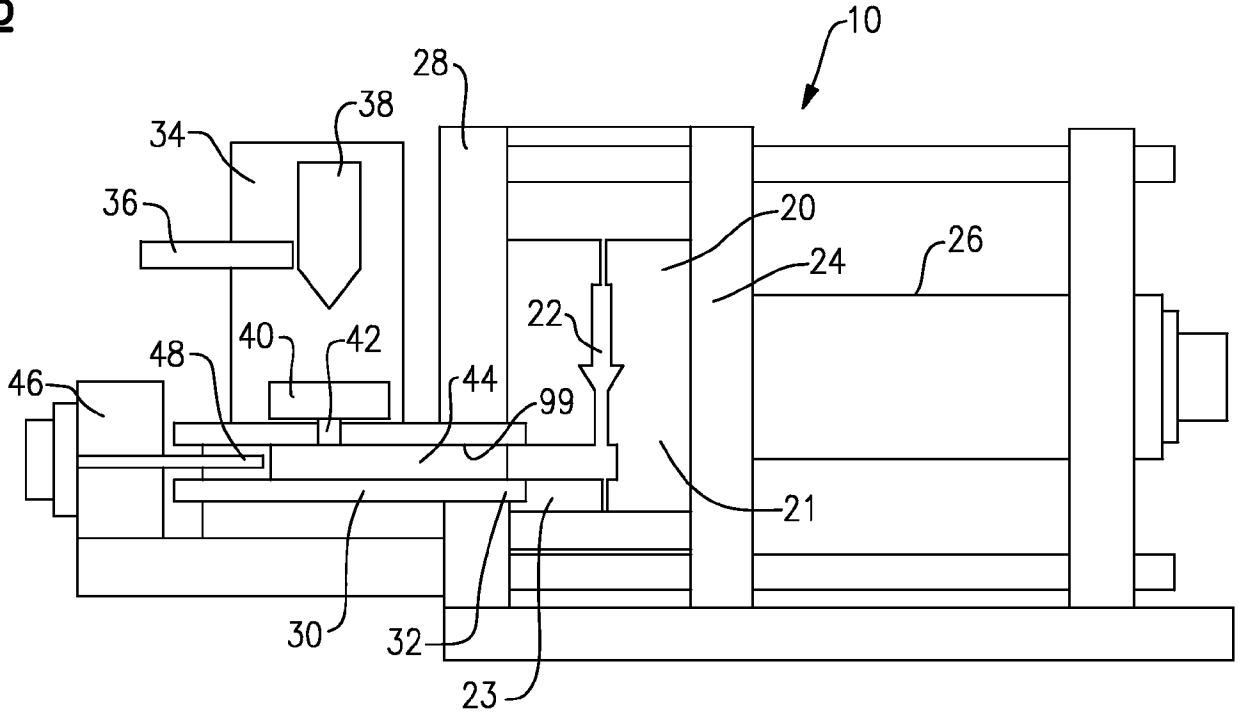
FIG. 1 shows a die-cast machine.

A die-cast machine 10 is illustrated in FIG. 1. As shown, a fixed mold half 23 is associated with a moveable mold half 21 to form an overall mold 20. While the two halves are disclosed to form the mold 20, additional mold inserts can be used to form the details of the cavity.

A cavity 22 is formed between the bodies of fixed and moveable halves 23 and 21. A fixed platen 28 mounts the fixed mold half 23, and moveable platen 24 moves with a piston and cylinder combination 26 such that the moveable die half 21 can be moved away from the fixed mold half 23 for removal of a component after the component has solidified in the cavity 22.

A vacuum chamber 34 includes an ingot 38 of a metal to be used for forming the component. An electron beam device 36 melts the ingot 38, which then falls into a copper crucible 40. From the copper crucible 40, molten metal passes through an opening 42 in an outer periphery of a shot tube 30. As shown, the shot tube 30 has a forward end 32 extending into the fixed mold half 23.

The molten material is shown at 44 within a bore 99 of the shot tube 30. A piston 48 is driven by a plunger 46 to urge the molten material into the cavity 22.

The inner bore 99 can be seen to extend through an entire axial length of the shot tube 20.

During use, the shot tubes 30 wear and must be replaced. In the prior art, the shot tube has been mounted in the fixed platen 23.

According to this disclosure, however, the shot tube 30 is mounted with its forward end 32 extending through the fixed platen 28 and into an aperture 101 in the fixed mold half 23. As shown, flats 108 are formed at an outer periphery of the shot tube 30, and plungers 104 are selectively biased into the flats 108 to secure the shot tube 30 within the fixed mold half 23.

In the illustrated embodiment, a source of hydraulic fluid 100 delivers fluid to passages 102, and into a chamber 106 to urge the plungers 104 into the flats 108. The hydraulic fluid can be released from chambers 106 to allow removal of the shot tube 30.

While flats 108 are shown, other shaped surfaces may be utilized to receive a locking member, such as plungers 104.

As also shown, an alignment structure 110 includes a tooth that fits into a notch 112 to properly position the shot tube 30 circumferentially relative to the fixed mold half 23.

Figure 3:
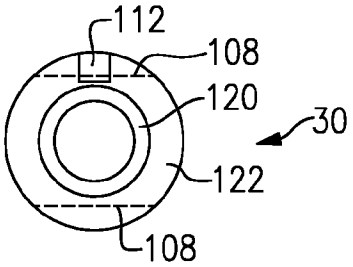
FIG. 3 is a cross-sectional view through a shot tube according to this application.
Figure 2:
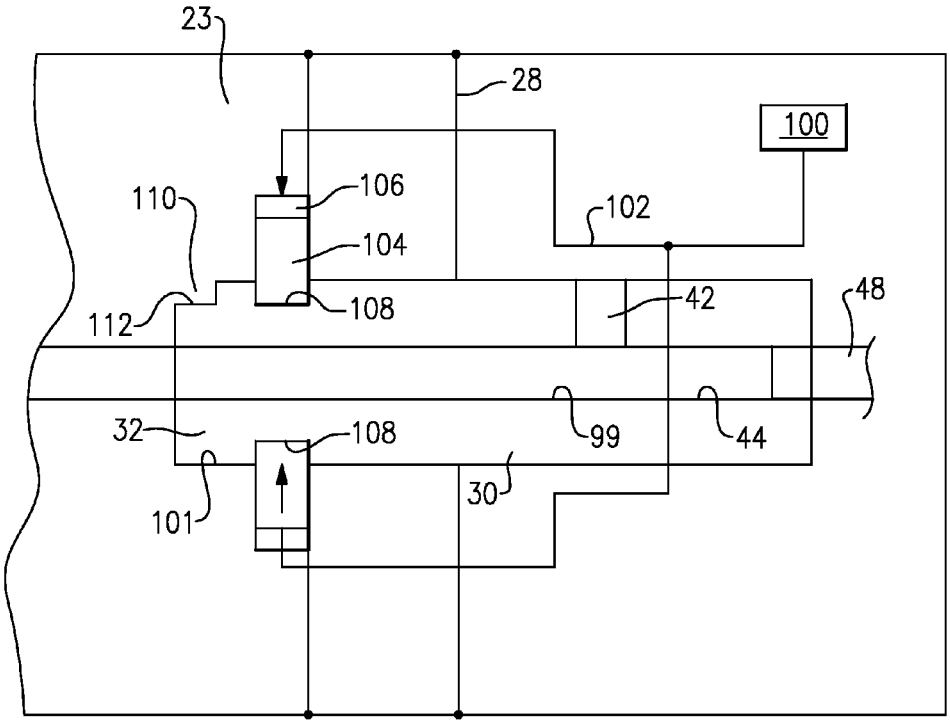
FIG. 2 shows a detail of a shot tube.

FIG. 3 shows the shot tube 30 having the flats 108 at opposed circumferential sides and the notch 112 at a forward end. The structure of the shot tube 30 has an inner powdered metal portion 120 and an outer stainless steel portion 122.

As can be appreciated, an outer periphery of the shot tube 32 is cylindrical, other than at the flats 108.

With this arrangement, the shot tube 30 may be easily replaced. To replace the shot tube 30, one merely removes the biased force of the hydraulic fluid, such that the plungers 104 move outwardly of the flats 108. The shot tube 30 may then be removed and a new shot tube inserted.

Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A die-cast fixed mold portion comprising:

a mold body defining a mold cavity at least in part;

an aperture in the mold body receiving a shot tube, and there being an alignment structure properly positioning said shot tube within said aperture; and said shot tube having an inner bore for delivering molten material into the mold body, said shot tube having an outer peripheral surface with at least one surface receiving a locking member to lock the shot tube;

an opening for receiving molten material into the inner bore;

said locking member being movable between a lock and a release position to lock the shot tube, and to allow removal of the shot tube; and said alignment structure includes a notch at a forward end of said shot tube and a tooth from the other of said forward end of said shot tube and said mold body.

2. The mold portion as set forth in claim 1, wherein said surface includes a pair of surfaces formed at an outer periphery of the shot tube.

3. The mold portion as set forth in claim 2, wherein said pair of surfaces are flats.

4. The mold portion as set forth in claim 3, wherein said shot tube outer periphery is cylindrical, other than at the flats.

5. The mold portion as set forth in claim 1, wherein said alignment structure includes said notch at said forward end of said shot tube and said tooth from said mold body.

6. The mold portion as set forth in claim 1, wherein said inner bore extends through an entire axial length of said shot tube.

7. The mold portion as set forth in claim 1, wherein said shot tube includes an inner portion formed of a powdered metal and an outer portion formed of stainless steel.

8. A die-cast machine comprising:

a mold with a fixed mold portion and moveable mold portion, a piston and cylinder for moving said moveable mold portion along with a moveable platen, and a fixed platen for mounting said fixed mold portion, a vacuum chamber for receiving an ingot of metal to be melted, and an electron beam apparatus for melting the ingot, a copper crucible for receiving molten metal, and said copper crucible delivering molten metal into a shot tube through an opening in the shot tube; and the fixed mold portion including a mold body defining a mold cavity at least in part;

an aperture in said fixed mold portion for receiving a shot tube, and an alignment structure properly positioning said shot tube within said mold body; and said shot tube having an inner bore for delivering molten material into the mold, said shot tube having an outer peripheral surface with at least one surface receiving a locking member to lock the shot tube into the aperture;

an opening for receiving molten material into the inner bore;

said locking member being movable between a lock and a release position to lock the shot tube, and to allow removal of the shot tube; and said alignment structure includes a notch at a forward end of said shot tube and a tooth from said mold body.

9. The die-cast machine as set forth in claim 8, wherein said surface includes a pair of surfaces formed at an outer periphery of the shot tube.

10. The die-cast machine as set forth in claim 9, wherein said shot tube outer periphery is cylindrical, other than at the pair of surfaces formed at the outer periphery of the shot tube.

11. The die-cast machine as set forth in claim 8, wherein said inner bore extends through an entire axial length of said shot tube.

12. The die-cast machine as set forth in claim 8, wherein said shot tube includes an inner portion formed of a powdered metal and an outer portion formed of stainless steel.

13. The mold portion as set forth in claim 1, wherein there are a pair of said at least one surfaces and a pair of said locking members locking said shot tube by being moved into a respective one of said pair of said at least one surfaces.

14. The mold portion as set forth in claim 13, wherein said locking members are movable between said lock and release positions by a fluid drive.

15. The die cast machine as set forth in claim 8, wherein there are a pair of said at least one surfaces and a pair of said locking member locking said shot tube by being moved into a respective one of said pair of said at least one surfaces.

16. The die cast machine as set forth in claim 13, wherein said locking members are movable between said lock and release positions by a fluid drive.

* * * * *